United States Patent [19]

Cilia

[11] 3,979,050

[45] Sept. 7, 1976

[54] MULTI-PLY FILM ARTICLES

[75] Inventor: Phillip F. Cilia, Palos Hills, Ill.

[73] Assignee: Union Carbide Corporation, New York, N.Y.

[22] Filed: Aug. 11, 1975

[21] Appl. No.: 603,293

Related U.S. Application Data

[63] Continuation of Ser. No. 399,315, Sept. 21, 1973, abandoned.

[52] U.S. Cl. ..... 229/66; 206/390

[51] Int. Cl.[2] ..... B65D 33/00

[58] Field of Search ..... 229/66, 69, 53; 53/187–190, 384–386; 206/390

[56] References Cited

UNITED STATES PATENTS

| | | | |
|---|---|---|---|
| 146,773 | 1/1874 | Murphy | 229/66 |
| 186,009 | 1/1877 | Jordan et al. | 229/66 |
| 3,224,574 | 12/1965 | McConnell et al. | 229/69 X |
| 3,348,762 | 10/1967 | Kasinkas | 229/69 |
| 3,411,698 | 11/1968 | Reynolds | 229/53 |
| 3,441,198 | 4/1969 | Ericson | 229/53 |
| 3,762,542 | 10/1973 | Grimes | 229/53 X |

FOREIGN PATENTS OR APPLICATIONS

| | | | |
|---|---|---|---|
| 693,714 | 9/1964 | Canada | 229/66 |

*Primary Examiner*—Stephen P. Garbe
*Attorney, Agent, or Firm*—Franklyn Schoenberg

[57] ABSTRACT

A multi-ply plastic film article having an openable end is provided comprising a first ply of flat flexible plastic film superimposed over a second ply of flat flexible plastic film and having opposite edges thereof joined and an openable end, at least a portion of the first ply of film defining the openable end being distorted to separate at least a portion of the confronting face of said first ply of film from the opposed confronting face of said second ply of film, whereby the distorted portion of film provides means for readily separating the confronting faces of the first and second plies of film.

10 Claims, 10 Drawing Figures

FIG. 7
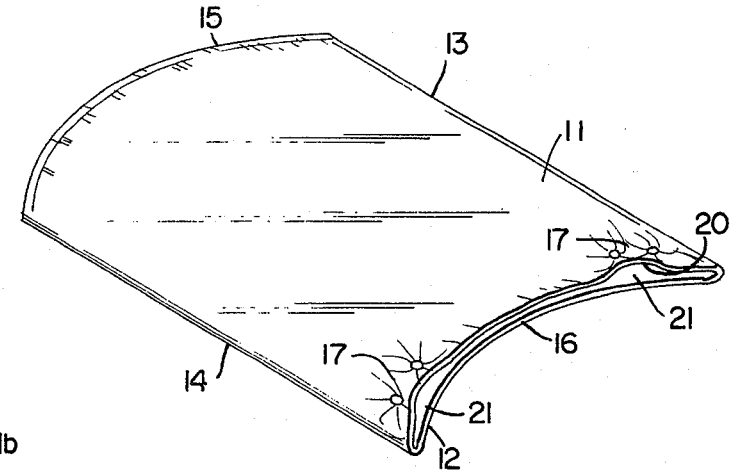
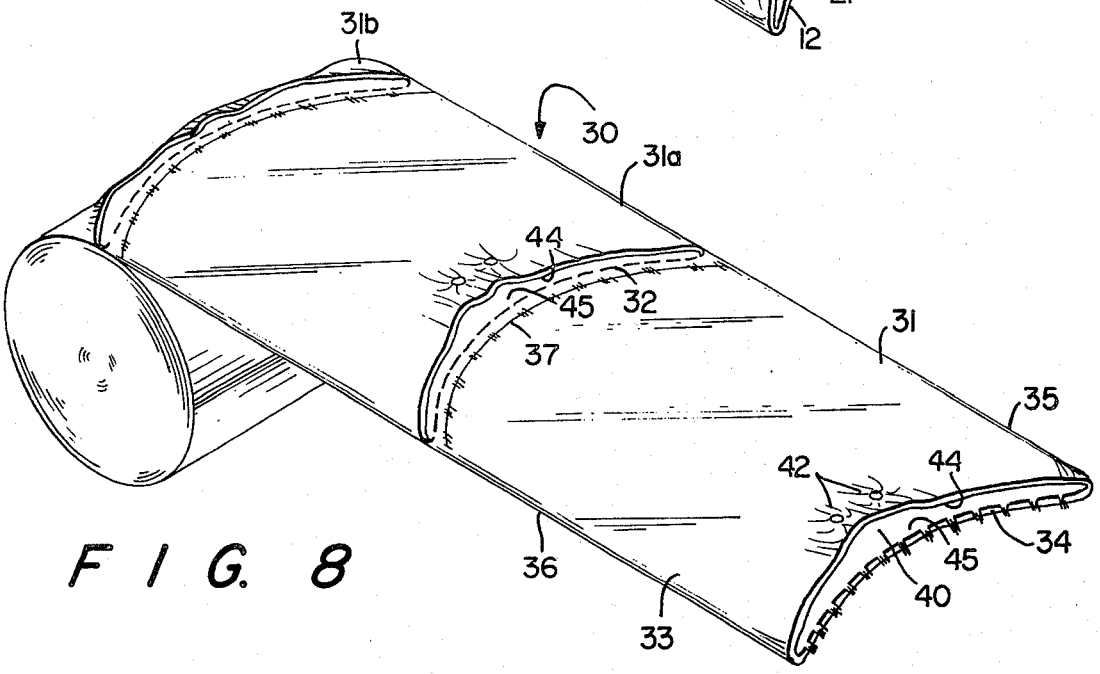
FIG. 8
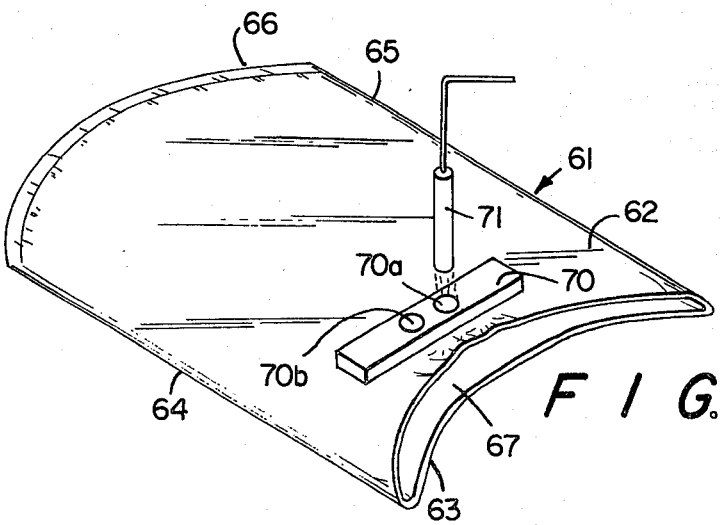
FIG. 9

MULTI-PLY FILM ARTICLES

This is a continuation of application Ser. No. 399,315 filed Sept. 21, 1973, now abandoned.

The present invention relates to improved flexible plastic articles, and more particularly to improved multi-ply flexible plastic film articles that are readily openable when supplied either individually or in continuous strips, and to a method of making the same.

Flat, flexible, multi-ply plastic film articles, such as bags, tubing and the like, have in recent years gained wide acceptance, being merchandised for both commercial and household use. Bags and other articles of this type serve satisfactorily for many uses, being supplied either as separate articles retained in a suitable container or, more recently, improved arrangements provide for the bags to be prepared in continuous strips so that they may be torn seriatim therefrom or used on mechanical automated packaging machines.

A problem arises, however, that has been found common to both arrangements, namely, the difficulty in separating the plies of film such as, for example, in opening a bag so that articles may be inserted therein for packaging and the like. The confronting surfaces of the bags being urged into facial engagement during preparation and storage tend to cling to each other, resisting separation and opening, a problem that is annoying to the housewife and particularly serious in commercial packaging application where delays in the operation are time consuming and expensive.

Heretofore, there have been a number of recommendations for dispensing cartons, bag arrangements and packaging equipment that will enable multi-ply film articles such as bags to be more readily opened, some examples of which are shown in U.S. Pat. Nos. 3,161,347; 3,194,124; 3,254,828; 3,501,085; 3,597,895; 3,618,286; 3,679,127. In general, the method and apparatus that are known have been found to be satisfactory for particular applications but the apparatus and methods are complex and complicated and are generally quite expensive.

In accordance with the present invention, there is provided a flat, flexible, multi-ply plastic film article comprising a first ply of flat, flexible, plastic film superimposed over a second ply of flexible plastic film and having opposite edges thereof joined and an openable end, at least a portion of said first ply of film defining the openalbe openable being distorted to separate at least a portion of the confronting face of said first ply of film from the opposed confronting face of said second ply of film, whereby the distorted portion of film provides means for readily separating the confronting faces of said first and second plies of film.

There is also provided in accordance with the present invention a method for preparing a flat, flexible, multi-ply plastic film article having a readily openable end, comprising distorting at least a portion of one ply of film defining the openable end of a flat, flexible, multi-ply film article and separating the confronting face of the portion of said ply of film from the confronting face of an opposed second ply of film, whereby means are provided for readily separating the confronting faces of said plies of film. Preferably, haating means are employed to distort said first ply of film relative to the second ply of film and one or more portions of said film may be so treated.

As employed throughout this specification and in the appended claims, it should be understood that the term "distortion" which results in separation of a portion of the confronting faces of film is intended to include within the meaning thereof the physical separation of the plies of film, lateral or longitudinal displacement of one ply of film with respect to the second ply of film wherein the original facial engagement of the confronting faces is broken, or a combination of physical separation and displacement of said plies of film.

The article of the present invention may be readily prepared using materials well known in the art and provides a simple and economical means for resolving a problem that has heretofore plagued the packaging art for a number of years.

Similarly, the method of the present invention employs means readily available and well known in the art and is suitable for use with a single article, a group of articles that are separated, or articles that are arranged in continuous separable strips or webs.

The article and method of the present invention will become apparent from the following description thereof when considered together with the accompanying drawing which is set forth as being exemplary of various embodiments of the present invention and is not intended, in any way, to be limitative thereof and wherein:

FIG. 7 is a perspective view of an exemplary embodiment of this invention;

FIG. 8 is a perspective view of an exemplary embodiment of this invention;

FIG. 9 is a perspective view illustrating a step in the method of the present invention;

Figure 1:
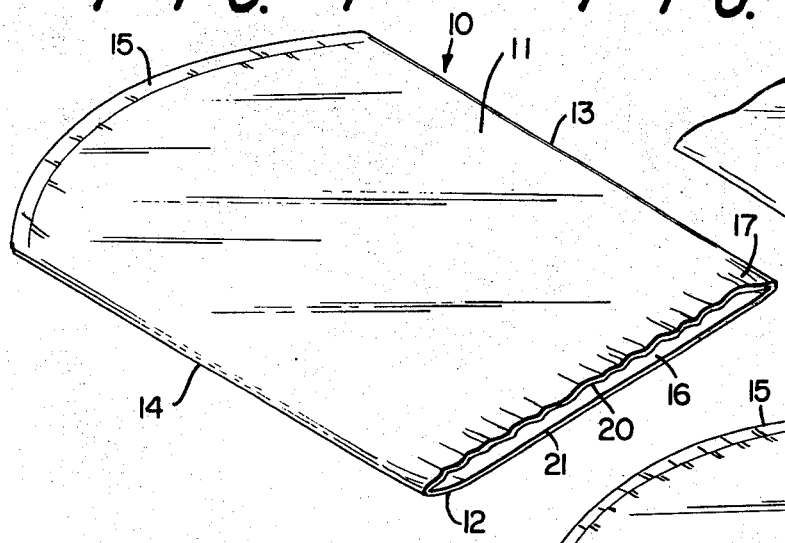
FIG. 1 is a perspective view of an exemplary embodiment of this invention.

Turning now to the drawing wherein like reference numerals denote like parts, there is illustrated in FIG. 1 an exemplary embodiment of the improved article of the present invention. The article, a flat, flexible plastic film bag designated generally as 10, comprises a first ply of flat, flexible film 11 superimposed over a second ply of flat, flexible plastic film 12 with three edges, 13, 14 and 15, of said plies being joined and having an open end 16. The portion 17 of said first ply of film 11 that defines the open end 16 of the bag 10 is "puckered", the distortion in said film extending across the full width of the open end 16 in said bag. The confronting face 20 of the portion of film 17 is separated from the confronting face 21 of the opposed portion of film 12 by the "puckering" distortion in the film 17, thereby providing means for grasping or for employing other means that would be obvious to those skilled in the art to readily separate the confronting faces of film 11 and 12 and open the bag.

Flexible plastic film suitable for use in the article of this invention may be prepared from any one of the film-forming polymers and copolymers well known in the art as, for example, polyvinylidene chloride and copolymers thereof, polyvinyl chloride, polyethylene, polypropylene, polyesters and the like. The first and second plies of film 11 and 12 used in the preparation of the article may be prepared from the same film materials or from a combination of film materials. The joined edges of said article, 13 and 14, may be formed by sealing congruent edges of film 11 and 12 by heat sealing, adhesive bonding and the like or may be a folded edge of film formed, for example, by collapsing a film tubing. The transverse edge 15 may be joined by heat sealing or bonding or may be a folded edge of film.

While the film employed in preparing the multi-ply film article of the present invention may be any one of a wide variety of materials or combinations thereof, it is preferred that the film employed will be one that distorts in some fashion, such as puckering, upon the application of heating means, and it is especially advantageous if the film is of the heat shrinkable type or exhibits some heat shrinkable characteristics.

It is important that the distortion in at least a portion of the first ply of film separates the confronting surface of said distorted portion of film from the opposed confronting surface of film and that said area of distortion does not resume its original facial engagement with the opposed film during further processing and storage.

Figure 2:
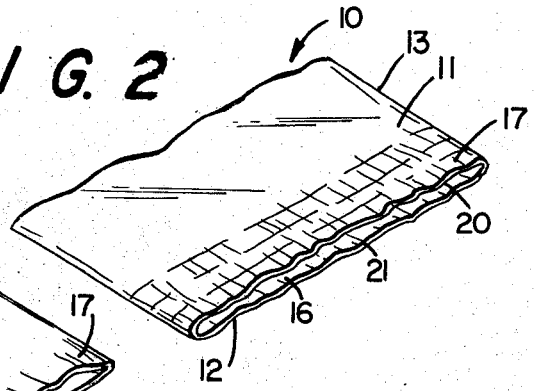
FIG. 2 is a fragmentary perspective view of an exemplary embodiment of this invention.
Figure 3:
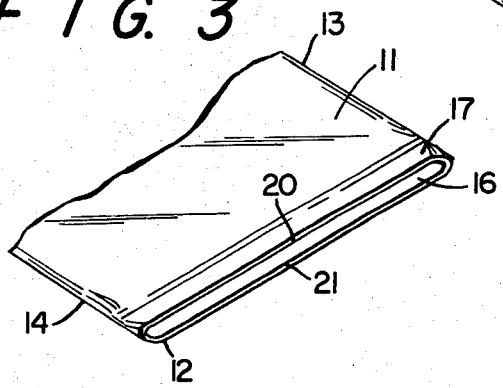
FIG. 3 is a fragmentary perspective view of an exemplary embodiment of this invention.

In FIGS. 2 and 3 are illustrated alternate embodiments of the film article of the present invention, wherein in FIG. 2 a first ply of film 11 and a second ply of film 12 defining the open end 16 are both distorted or puckered but the degree of distortion in each of the plies of film is different and the differential degree of distortion separates the confronting faces 20 and 21 of the plies of film 11 and 12, and in FIG. 3 a short length 17 of the first ply of film 11 defining the open end 16 is "puckered" and deflected upwardly or curled at the open end 16 of article 10. The distorted portion 17 of the film ply 11 illustrated in FIG. 3 extends across the transverse width of the article 10 from a portion of the film 11 that was subjected to heating means to the open end 16 and separates the confronting face 20 from the opposed confronting face 21.

As can be appreciated, the edge portion of the first ply of film 11 defining the open or openable end of a film article may be distorted or the portion of said first ply of film that is distorted may be somewhat remote from the edge thereof provided that the distortion in said film ply results in separation of the confronting face of the film ply 11 from the opposed confronting face of the second ply of film 12. Further, the area of distortion in film ply 11 may, for example, extend the full width of the film ply 11 or may be limited to a portion or to two or more spaced-apart portions of said film ply 11.

Figure 4:
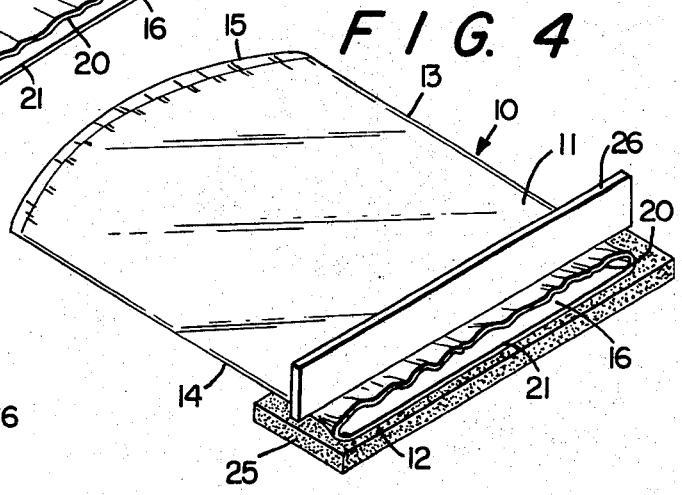
FIG. 4 is a perspective view illustrating a step in the method of the present invention.
Figure 6:
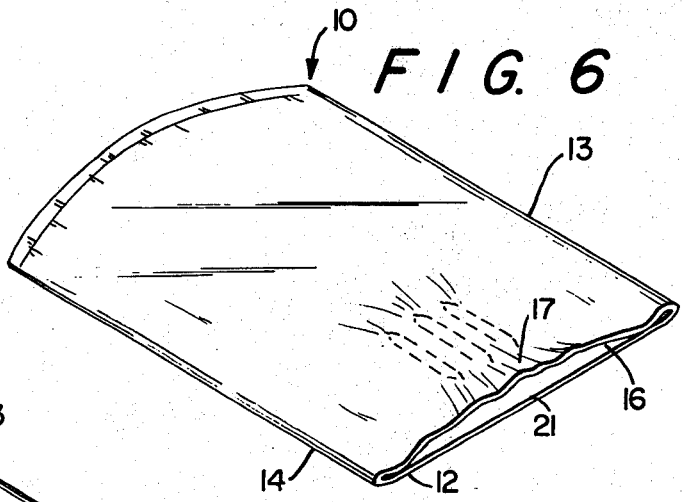
FIG. 6 is a perspective view of an exemplary embodiment of this invention.
Figure 5:
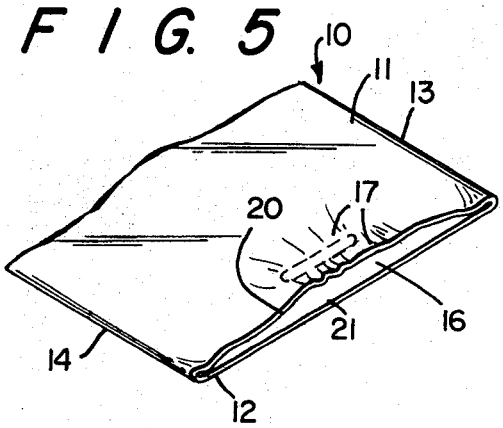
FIG. 5 is a fragmentary perspective view of an exemplary embodiment of this invention.

In FIGS. 5, 6 and 7 are illustrated other alternate exemplary embodiments wherein only a portion of film 11 defining the open end 16 is distorted. In FIG. 5 a short length 17 of the film 11 defining the open end 16 is distorted or "puckered" intermediate the edges 13 and 14 of film article 10 separating the confronting face 20 thereof from the opposed confronting face 21 of film ply 12. In FIG. 6 three spaced-apart puckered ribs 17 of film 11 intermediate the edges 13 and 14 are formed in the film ply 11 defining the open end 16 separating the confronting faces 20 and 21 from each other. In FIG. 7 two spaced-apart "puckered regions" 17 of film 11, intermediate the edges 13 and 14, are formed in the film ply 11. In each of the illustrated exemplary embodiments, the portions of distorted film wherein the confronting face thereof is separated from the opposed confronting face provide means whereby the separated plies of film may be manually or mechanically engaged or grasped, thereby enabling the full length of the two plies of film to be readily separated as, for example, in opening a bag for insertion of an article to be packaged. With the main exception being the areas and types of distortion in the film, the embodiments illustrated in FIGS. 2, 3, 5, 6 and 7 of the drawing are identical to the exemplary embodiment illustrated in FIG. 1. Therefore, the multi-ply film articles of FIGS. 3, 4, 5, 6 and 7 will be designated with the same number 10 and identical parts in the later embodiments will not be described again but will be shown on the drawing with the same numeral designations.

As is obvious, the film article of the present invention may be a tube or sleeve, an individual article such as a bag, or a plurality of separable articles such as bags prepared in a continuous strip of bags by any one of a number of means well known in the art.

In FIG. 8 is illustrated an alternate embodiment of the invention, a continuous strip of separable flat, flexible plastic film articles supplied in roll form and designated generally as 30. The continuous strip comprises a plurality of flat, flexible film articles, such as bags 31, 31*a*, 31*b*, each article being readily separable from the succeeding article along a line of weakness 32. The articles in the strip are joined successively along the bottom ply of film 34, the top ply of film 33 being separated from the preceding article. The articles 31, 31*a*, 31*b* each have a top ply of film 33 superimposed over a bottom ply of film 34 with the opposite longitudinal edges, 35 and 36, joined. The transverse edge 37 of each of the articles 31, 31*a*, 31*b*, is also joined and the articles have an openable end 40. Two spots of distortion or "puckering" 42 are provided in the portion of the top ply of film 33 defining the openable end 40 of the articles 31, 31*a*, 31*b*, said spots of distortion being intermediate the joined edges 35 and 36 of said articles. The confronting face 44 of the distorted portion of the top ply of film 33 is separated from the confronting face 45 of the opposed ply of film 34 providing means for readily separating the full length of the top and bottom plies of film 33 and 34 in each of the articles 31, 31*a*, 31*b*.

Figure 10:
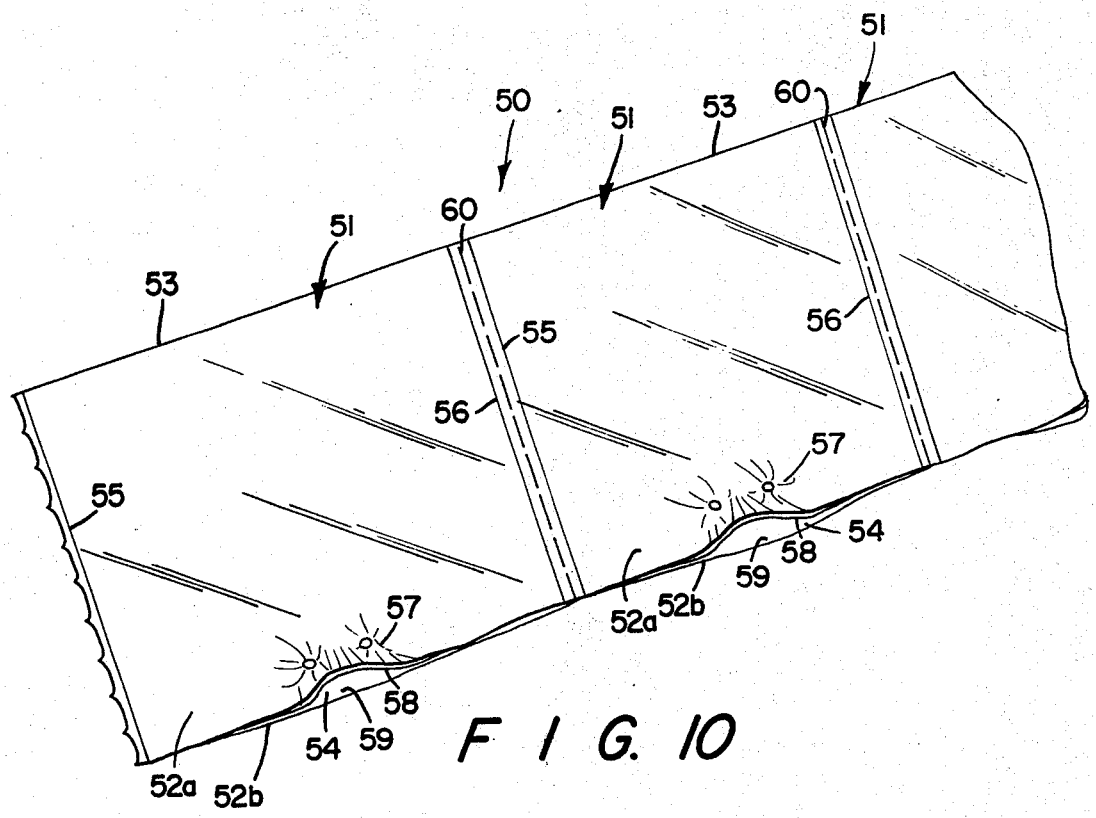
FIG. 10 is a fragmentary perspective view of an exemplary embodiment of this invention.

In FIG. 10 is illustrated a continuous strip of separable side-welded bags designated generally as 50. The strip of bags 50 is prepared from a continuous web of film longitudinally folded with a first ply of film 52*a* superimposed over a second ply of film 52*b* to form the opposed faces of the individual bags, each designated generally as 51. Each of the bags 51 has opposite side-welded edges 55 and 56, a closed bottom 53 and an open end 54 and are separable along lines of weakness 60. A short length 57 of the first ply of film 52*a* defining the open end 54 is distorted intermediate the side-welded seals 55 and 56, separating the confronting face 58 of the first ply of film 52*a* from the opposed confronting face 59 of the second ply of film 52*b* providing means for readily separating the full length of the confronting faces of film plies 52*a* and 52*b* and opening the bag 51.

A typical method for preparing the improved multi-ply plastic film articles of the present invention will now be described and will be more readily understood when considered together with FIG. 4.

A bag 10 having an open end 16 is prepared from two plies 11 and 12 of superimposed flexible plastic film such as, for example, biaxially oriented heat-shrinkable polyethylene joined at congruent edges 13, 14 and 15 using methods well known in the art. The film defining the open end 16 of the bag 10 is placed in a conventional heat sealing press, the bottom ply of film 12 being supported on a rubber pad 25, such as a 3/16 inch thick pad of heat-resistant rubber. A ¼ inch wide bar, 26, heated to a temperature of about 200°F., by means not shown, is applied at a light pressure, such as about one pound force per inch of bag width, to the surface of the top ply of film 11 about ¼ inch from the open end 16 of the bag and parallel thereto for a short period of time, such as about ½ second. The top 11 and bottom 12 plies of film in the region contacted by bar 26 differentially "curl" and "pucker" and the confronting faces of the piles of film 20, 21 separate providing means for a ply of the film to be grasped and the bag to be readily opened. It is important that the temperature, pressure and time of application of the heating means be controlled so that the plies of film do not fuse together, yet the conditions must be such that the portion of the ply or plies of film in the region treated are distorted and the confronting faces of the distorted film separate.

As can be appreciated, alternative known heating means may be employed to impart the desired distortion to a ply of film defining an openable end of a multi-ply film article in accordance with the practice of the invention.

A film article such as the bag 10 illustrated in the drawing having an open end 16 may, for example, be treated with heat sealing devices, such as a heated narrow bar, an impulse heat sealer and the like. The plies of film 11 and 12 defining the open end 16 of the film article 10 may be supported on the metal work surface of a heat sealing device. A heated narrow bar sealer blade may then be impinged onto the desired portion of the surface of the top ply of film 11 for a very short period of time under light pressure to impart the desired distortion, generally a "puckering" of the film ply 11. The "puckering" distortion of film ply 11 results in the separation of the confronting face 20 from the opposed confronting face 21 of the second ply of film 12 as illustrated in FIG. 1. Alternatively, an impulse heat sealer device may be impinged on the supported surface of the ply of film 11 adjacent the open end of the article 10. The use of a low heat will distort and curl the end 17 of the ply of film 11 from the point of contact by the impulse sealer, separating the confronting face 20 of the curled portion of film 11 from the opposed confronting face 21 of the film 12 as illustrated in FIG. 3.

Multi-ply, flat, flexible plastic film articles having an openable end as, for example, preformed bags or tubing as herein described, may be prepared from a wide variety of flexible plastic film materials using methods well known in the art. The distortion imparted to a portion of the first ply of film defining the openable end of the article may extend across the full width of the film defining the openable end or may be localized in one or more areas intermediate the opposite joined edges extending from the openable end of the article. In any event, the separation of the confronting faces of the plies of film defining the openable end of the article should be of a permanent nature and should be sufficient to enable the full length of film plies to be readily separated using mechanical or manual menans.

Accordingly, a multi-ply film article having an openable end, such as, for example, the bag 61 illustrated in FIG. 9 formed from plies of film 62 and 63, and having opposite joined edges 64 and 65, a transverse joined edge 66 and an openable end 67, may be treated with heating means to impart distortion to localized areas of the first ply of film 62. A template 70 having holes **70*a*, 70*b* cut therethrough is positioned over the portion of the ply of film 62 in the area to be distorted. A hot air gun 71, such as an "Allen Universal Welding Gun" positioned with its outer tip above each hole in the template (as, for example, about 2 inches above) may be used to apply heated air (about 600°F.) for a brief period, e.g., about ½ second, to the film. The top ply of film 62 distorts upon application of the hot air and the confronting face of the film 62 separates from the opposed confronting face of film 63 as illustrated in FIG. 9 and as further illustrated in FIGS. 7, 8 and 10**.

Alternatively, puckering distortion may be imparted to the desired portion of the first ply of film by impinging a short heated bar onto the surface of the first ply of film producing distortion as illustrated in FIGS. 5 and 6 or a torch flame as emitted from an acetylene gas gun may also be suitable.

Although heating means have been more particularly described in connection with providing distortion in a portion of the first ply of superimposed plastic film defining the openable end of a multi-ply film article, the invention is not limited thereto. Any other means, including for example, mechanical distortion, irradiation and the like, to distort the first ply of film defining the openable end of the film article may be employed so long as it provides for separating the opposed confronting faces or portions thereof of the film defining the openable end and the original facial engagement of the opposed confronting faces is not reimposed by further processing and storage of the article. While in the foregoing specifications embodiments of the invention have been set forth in considerable detail for purposes of making a complete disclosure thereof, it will be apparent to those skilled in the art that numerous changes may be made without departing from the spirit and principles of the invention.

What is claimed is:

1. A flat flexible multi-ply plastic film article comprising a first ply of flat flexible plastic film superimposed over a second ply of flat flexible plastic film, having opposite edges thereof joined and an openable end with substantially aligned edges, characterized by a portion of said first ply of film defining the openable end being puckered and non-uniformly distorted, separating a portion of the confronting face of said first ply of film from the opposed confronting face of said second ply of film and displacing a portion of said aligned edge of said first ply of film relative to the opposing aligned edge of said second ply of film, said displaced edge portion of film being contracted and drawn back generally towards a central portion of said article, whereby the distorted portion of film provides means for grasping and readily separating the confronting faces of said first and second plies of film.

2. The film article of claim 1 wherein said first and second plies of film exhibit heat-shrinkable properties.

3. The film article of claim 1 wherein said film article is a bag.

4. The film article of claim 1 wherein said film article is a tube.

5. The film article of claim 1 wherein the portion of the first ply of film distorted extends across the width of said open end.

6. The film article of claim 1 comprising at least two spaced-apart portions of distortion in said first ply of film.

7. The film article of claim 1 wherein a portion of said second ply of film is distorted, the distortion in said second ply of film being different from the distortion in said first ply of film.

8. A continuous strip of separable flat flexible multi-ply plastic film articles comprising a length of a first ply of flat flexible plastic film superimposed over a second ply of a flat flexible plastic film said superimposed plies of film being joined along at least one pair of congruent longitudinal edges thereof and having a plurality of spaced-apart transverse seams to form a plurality of interconnected separable bags having openable ends each of said ends having substantially aligned edges, each of said bags being separable along transverse lines of weakness in said plies of film, at least a portion of said first ply of film defining the openable end in each of said bags, said portion being puckered and non-uniformly distorted, separating a portion of the confronting face of said first ply of film from the opposed confronting face of said second ply of film and displacing a portion of said aligned edge of said first ply of film at the openable end of each of said bags relative to the opposing aligned edge of said second ply of film, said displaced edge portions of film being contracted and drawn back generally towards the opposite closed edges of each bag, whereby the distorted portion of film provides means for grasping and readily separating the confronting faces of the film.

9. The continuous strip of articles of claim 8 wherein joined congruent longitudinal edges of said plies of film define opposite side edges of each of the bags in said interconnected strip of bags and a transverse seam joins the superimposed plies of film to form the bottom edge of each of said bags.

10. The continuous strip of articles of claim 8 wherein one pair of congruent longitudinal edges defines an openable end in each of said separable bags, said spaced-apart transverse seams define opposite side edges of each of said bags, and said transverse lines of weakness are located between seams forming the side edges of successive bags in the strip of bags.

* * * * *

UNITED STATES PATENT OFFICE

CERTIFICATE OF CORRECTION

Patent No. 3,979,050 Dated September 7, 1976

Inventor(s) Philip F. Cilia

It is certified that error appears in the above-identified patent and that said Letters Patent are hereby corrected as shown below:

Change the patentee's name to read -- Philip F. Cilia --

Column 1, line 63, "haating" should read -- heating --

Column 1, line 48, "openalbe openable" should read -- openable end --

Signed and Sealed this fifth Day of July 1977

[SEAL]

Attest:

RUTH C. MASON
*Attesting Officer*

C. MARSHALL DANN
*Commissioner of Patents and Trademarks*